US005966972A

United States Patent [19]

Chuang

[11] Patent Number: 5,966,972

[45] Date of Patent: Oct. 19, 1999

[54] KEY RING ASSEMBLY CONTAINING A LASER INDICATOR AND VARIOUS CUTTERS

[76] Inventor: Kun-Hu Chuang, 338, Section one, Ching-Tao Rd., Taichung, Taiwan

[21] Appl. No.: 09/250,455

[22] Filed: Feb. 16, 1999

[51] Int. Cl.[6] ..... A47G 29/10

[52] U.S. Cl. ..... 70/456 R

[58] Field of Search ..... 70/456 R–459; 24/3 U; D3/207–212

[56] References Cited

U.S. PATENT DOCUMENTS

| | | | |
|---|---|---|---|
| 2,393,373 | 1/1946 | Hendrix | 70/456 R |
| 2,412,056 | 12/1946 | Mosch | 70/456 R |
| 2,630,212 | 3/1953 | Mosch | 70/456 R X |
| 2,640,347 | 6/1953 | Majeski | 70/456 R |
| 2,657,569 | 11/1953 | Hill | 70/456 R |
| 2,706,902 | 4/1955 | Nichols | 70/456 R |
| 2,795,128 | 6/1957 | Ly | 70/456 R |
| 4,524,594 | 6/1985 | Bascou | 70/459 X |
| 4,660,397 | 4/1987 | Girimont | 70/456 R |
| 4,831,504 | 5/1989 | Nishizawa et al. | 70/456 R X |

FOREIGN PATENT DOCUMENTS

| | | | |
|---|---|---|---|
| 482277 | 4/1952 | Canada | 70/456 R |
| 117204 | 8/1984 | European Pat. Off. | 70/456 R |
| 3902537 | 8/1990 | Germany | 70/456 R |
| 721953 | 11/1966 | Italy | 70/456 R |
| 1286400 | 8/1972 | United Kingdom | 70/456 R |

*Primary Examiner*—Suzanne Dino Barrett
*Attorney, Agent, or Firm*—Alan Kamrath; Oppenheimer, Wolff & Donnelly, LLP

[57] ABSTRACT

A key ring assembly containing a laser indication and various cutters includes a body, an upper cover, a metal plate, and a base. The upper cover is disposed on the body, and a battery unit, a press button, a laser generator, and a replaceable lens frame are disposed in a space defined between the upper cover and the body, whereby laser beams conveying different meanings are emitted. One side of the base is provided with a plurality of insert grooves adapted to receive a plurality of different lens frames. Four elastic curved arms, a file, a pen blade, and scissors are pivotally provided on the metal plate. Each of the file, the pen blade, and scissors is provided with a retaining slot at a rear end thereof to be positioned and retained on the elastic curved arms.

1 Claim, 4 Drawing Sheets

KEY RING ASSEMBLY CONTAINING A LASER INDICATOR AND VARIOUS CUTTERS

BACKGROUND OF THE INVENTION (a) Field of the Invention

The present invention relates generally to a key ring assembly, more particularly to a key ring assembly containing a laser indicator and various cutters. The key ring assembly containing a laser indicator and various cutters includes a body, an upper cover, a laser generator, a metal plate, and a base. The base is provided with a recess for receiving the laser generator and a battery chamber for receiving a battery unit. The upper cover has a front end provided with a cavity and a through hole. The cavity is adapted for receiving a replaceable lens frame. The lens frame is provided with plastic lenses containing geometric shapes or patterns or signs or words or characters so that laser beams of different shapes can be emitted. The upper cover is disposed on an upper side of the body. The metal plate is disposed below said body and has two spaced-apart positioning posts arranged at both front and rear ends of both top and bottom sides thereof for pivotally connection with four elastic curved arms, a file, a pen blade, and scissors. Each of the file, the pen blade, the scissors has a retaining slot at a rear end thereof, and a finger dent on one side whereby the user can turn the file, the pen blade or the scissors outwardly with respect to the metal plate. The file, the pen blade, and the scissors are and positioned on the elastic curved arms by means of the retaining slots. The base is provided with a plurality of insert grooves adapted for receiving a plurality of replaceable lens frames of different applications.

(b) Description of the Prior Art:

There are available on the market key ring assemblies for carrying keys, remote controls, and decorations. To enhance the market value and functions of conventional key ring assemblies, it is desirable to have a key ring assembly that contains a laser indicator and various cutters.

SUMMARY OF THE INVENTION

A primary object of the present invention is to provide a key ring assembly containing a laser indicator. According to this aspect of the present invention, a key ring assembly includes a body, an upper cover, and a base. The body is provided with a recess for receiving a laser indicator and a battery chamber for receiving a plurality of cadmium nickel cells for supplying electric power to the laser indicator. The upper cover is disposed on an upper side of the body. A front end of the upper cover is formed with a cavity and a through hole. The cavity has inserted therein a replaceable lens frame. The center of the lens frame is configured to have various geometric patterns, signs, words, characters, or patterns, whereby laser beams for purposes of indication, display or literal communication can be emitted for use in teaching, briefing, etc. One side of the base is provided with a plurality of insert grooves for receiving a plurality of replaceable lens frames for different applications.

Another object of the present invention is to provide a key ring assembly containing a laser indicator and various cutters. According to this aspect of the present invention, the key ring assembly further includes a metal plate disposed below the body. The metal plate has two spaced apart positioning posts disposed on both front and rear ends of both upper and lower sides thereof for pivotal connection with four elastic curved arms, a file, a pen blade, and scissors. Each of the file, the pen blade, and scissors is provided with a retaining slot at a rear end thereof, whereby the file, the pen blade, and the scissors can be retained and positioned on the elastic curved arm when they are turned outwardly with respect to the metal plate.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
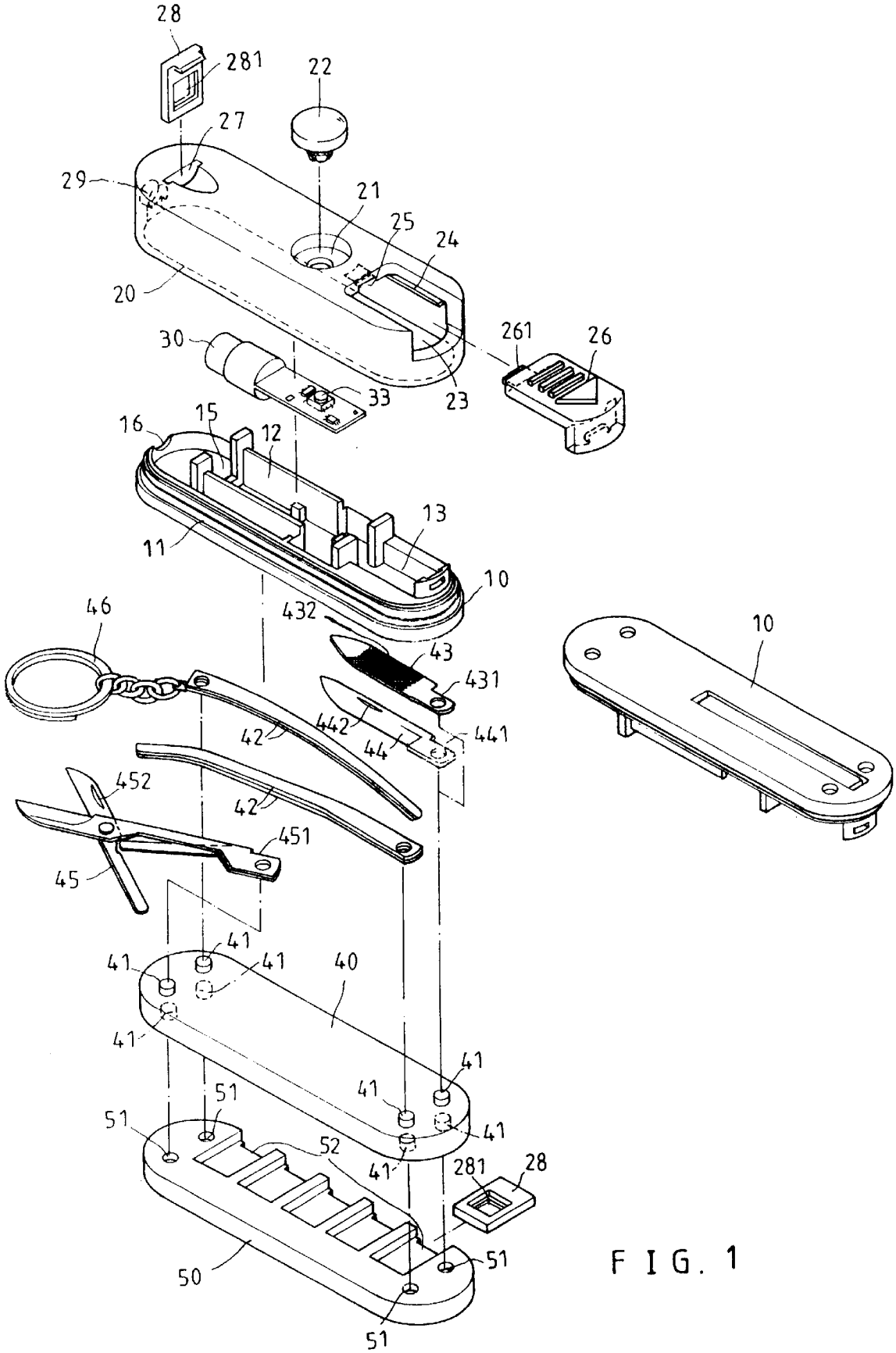
FIG. 1 is an exploded perspective view of a preferred embodiment of a key ring assembly having a laser indicator and various cutters according to the present invention.

Referring to FIG. 1, the preferred embodiment of a key ring assembly containing an laser indicator and various cutters according to the present invention is shown to include a body 10, an upper cover 20, a laser generator 30, a metal plate 40, and a base 50.

The body 10 has a periphery that is configured to have stepped edges 11 and is provided for receiving the upper cover 20. The body 10 is provided with a recess 12 and a battery chamber 13 on an upper side thereof. The laser generator 30 is disposed in the recess 12, whereas a plurality of cadmium nickel battery cells 14 are disposed in the battery chamber 13. The battery cells 14 supply the laser generator 30 with the necessary electric power. The recess 12 has a U-shaped hole 15 provided at a front end thereof. The stepped edge 11 at a front end of the body 10 is provided with an indentation 16. The U-shaped hole 15 is aligned with the indentation 16 for passage of laser light therethrough.

The upper cover 20 is fitted on the body 10 such that it can rest upon the stepped edges 11 of the body 10. An upper side of the upper cover 20 is provided with a circular button mounting hole 21 at a position corresponding to the recess 12 of the body 10 for receiving a press button 22. By pressing the press button 22, a power switch 33 of the laser generator 30 can be actuated. The upper cover 20 is further provided with an opening 23 at a position corresponding to the battery chamber 13. Flanges 24 are provided on both sides of the opening 23, and a retaining slot 25 is disposed at a front end of the opening 23 for securing a battery cover 26. The battery cover 26 has a retaining hook 261 that can just engage the retaining slot 25. The upper cover 20 is further provided with a cavity 27 at a position corresponding to the U-shaped hole 15 of the body 10 for receiving a replaceable lens frame 28. The center of the lens frame 28 may be provided with plastic lenses 281 containing words, characters, signs, or patterns for indication or display purposes. The words, characters, signs, or patterns on the plastic lenses 281 are constituted by etching pits formed thereon using etching. When the laser beam passes through the plastic lenses 281, it will disperse and converge on the etching pits to send out laser lights carrying different meanings. The front end of the upper cover is further provided with a through hole 29. The laser beam passes through the plastic lenses 281 and is emitted through the indentation 16 and the through hole 29.

The laser generator 30 is received in the recess 12 of the body 10. Positive and negative electrically conductive plates 31, 32 are provided at a rear end of the laser generator 30, and are electrically connected to the battery chamber 13 of the body 10. The above-mentioned power switch 33 is disposed on an upper side of the laser generator 30. The power switch 33 can be pressed using the press button 20 to control power supply to the laser generator 30.

The metal plate 40 is provided with two spaced-apart positioning posts 41 at both front and rear ends of both the top and bottom sides thereof for pivotal connection with four elastic curved arms 42, a file 43, a pen blade 44, and scissors 45. The scissors 45 is received on a concave side of the elastic curved arms 42. The file 43 and the pen blade 44 are stacked and together stored on a convex side of the elastic curved arms 42. Each of the file 43, the pen blade 44, and the scissors 45 is provided with a retaining slot 431, 441, 451 at a rear end thereof. In addition, each of the file 43, the pen blade 44, and the scissors 45 is provided with a fingernail dent 43 432, 442, 452 to allow the user to use their fingernails to turn the file 43, the pen blade 44, and the scissors 45 outwardly from their metal plate 40 for use. The retaining slots 431, 441, 451 are provided to secure the file 43, the pen blade 44, and the scissors 45 on the elastic curved arms 42 so that they can be positioned thereon. A key ring 46 is pivotally disposed on one of the elastic curved arms 42 to facilitate carrying.

The base 50 is provided with two spaced-apart positioning holes 51 at both front and rear ends thereof to corresponding to the positioning posts 41 on the bottom side of the metal plate 40 so as to retain the metal plate 40 disposed thereon. One side of the base 50 is formed with a plurality of insert grooves 52 for receiving a plurality of lens frames 28 having different applications.

Figure 3:
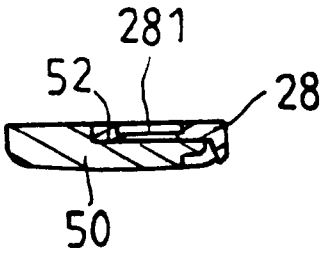
FIG. 3 is a schematic view illustrating a lens frame received in a base of the key ring assembly of the present invention.
Figure 2:
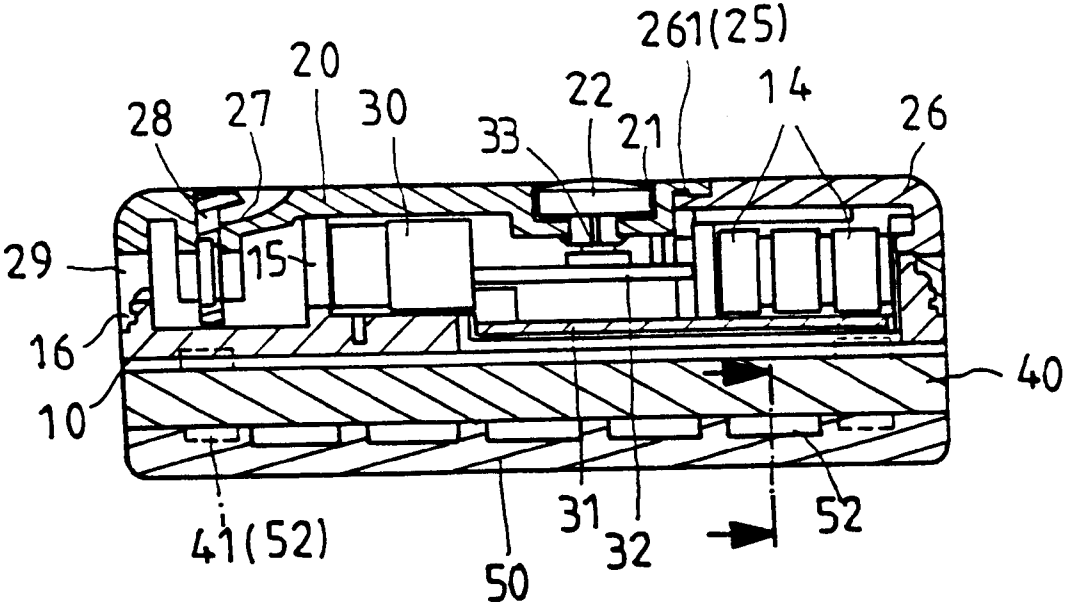
FIG. 2 is an assembled sectional view of the preferred embodiment.
Figure 4:
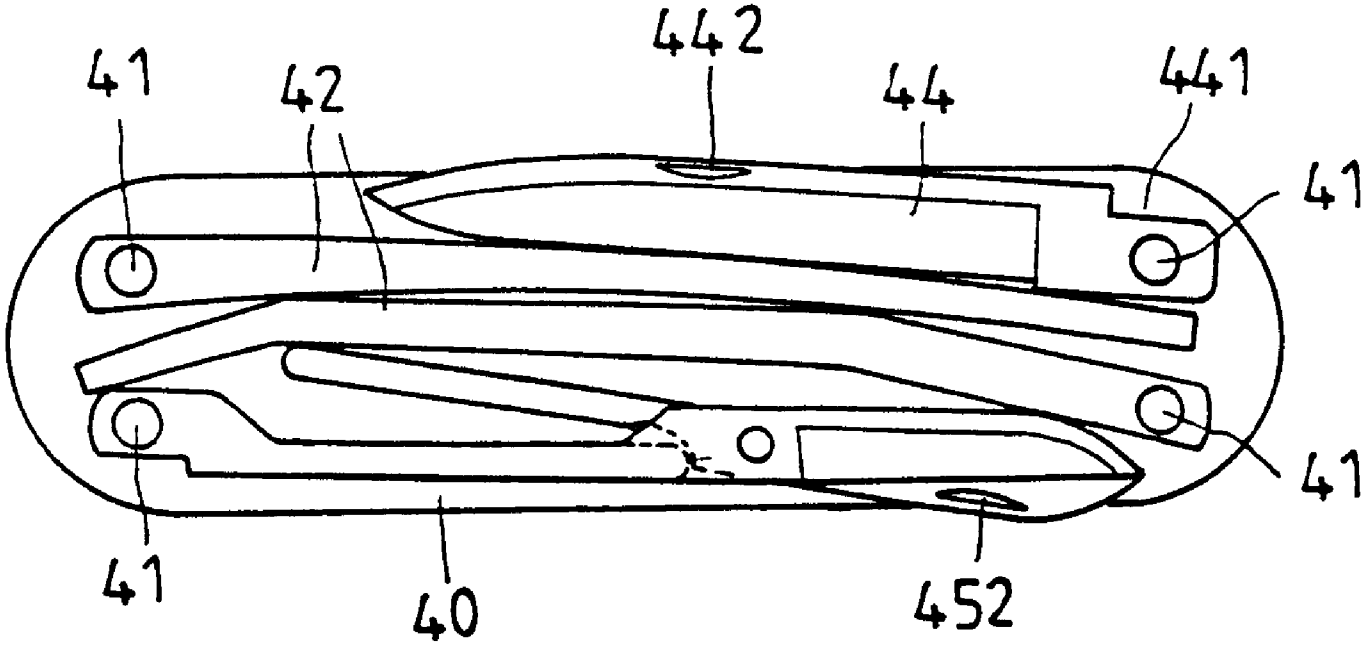
FIG. 4 is a schematic view of the preferred embodiment illustrating a file, a pen blade, and scissors received in a closed position.
Figure 5:
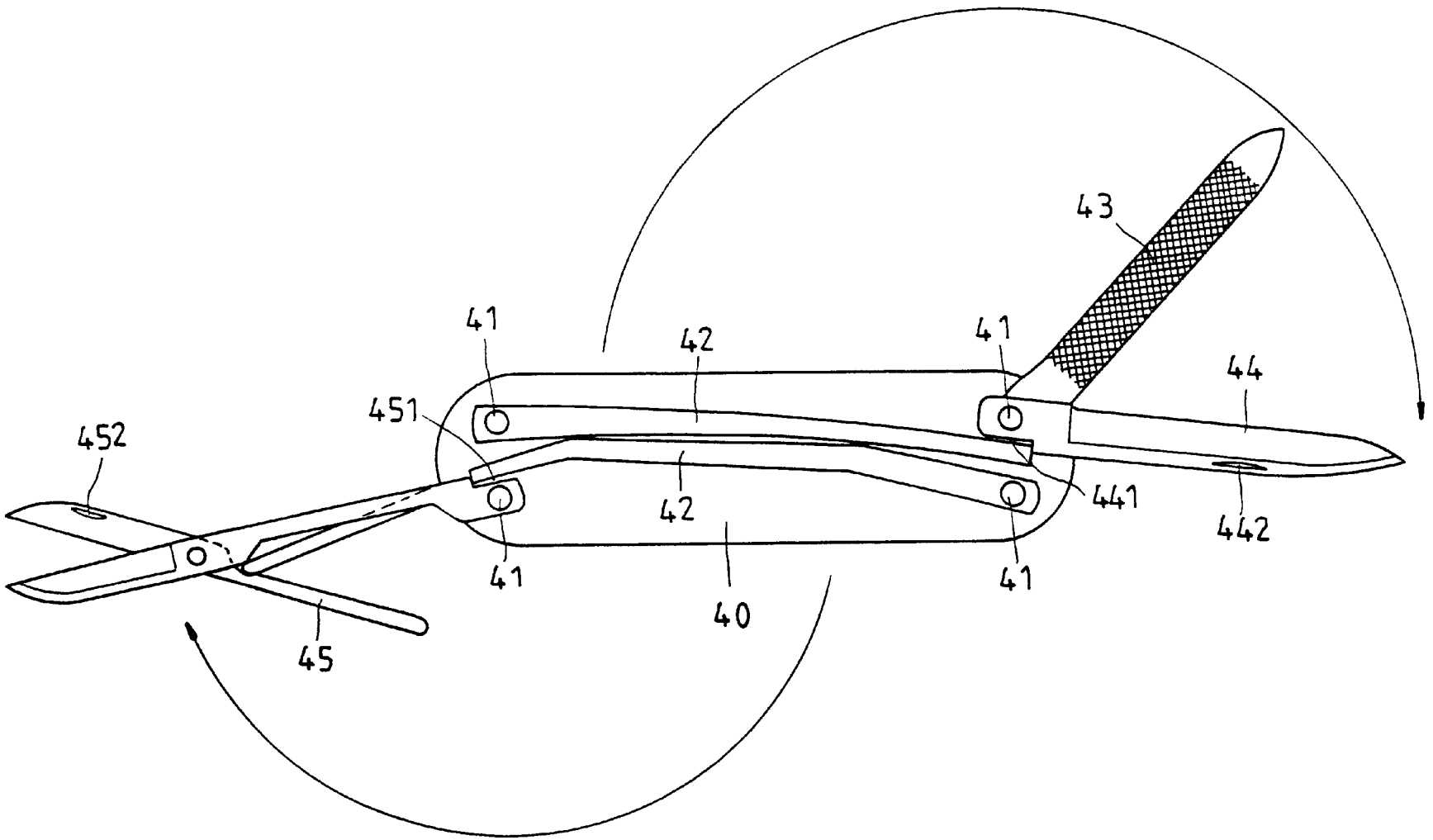
FIG. 5 is a schematic view of the preferred embodiment illustrating the file, the pen blade, and the scissors that are turned outwardly with respect to a body of the key ring assembly.

With reference to FIG. 2, in use, the user can press the press button 22 to actuate the power switch 33 of the laser generator 30. The laser beam then passes through the plastic lenses 281 of different applications (such as circles, hearts, diamonds, stars, arrows, etc., or words or patterns) at the center of the lens frame 28 to send out laser lights carrying different meanings. Referring to FIG. 3, the user can pick out the required lens frames 28 from the insert grooves 52 of the base 50 to be used in a lecture, seminar, presentation or briefing, utilizing the laser lights carrying different meanings for purposes of indication, display or ideas communication. With reference to FIGS. 4 and 5, if the user wants to use any one of the file 43, the pen blade 44, and the scissors 45, he/she only needs to use a finger to move it out from the metal plate 40. As the file 43, the pen blade 44, and the scissors 45 are provided with retaining slots 431, they can be retained and positioned on the elastic curved arms 42. The key ring 46 allows the user to carry the present invention in a convenient manner.

Although the present invention has been illustrated and described with reference to the preferred embodiment thereof, it should be understood that it is in no way limited to the details of such embodiment but is capable of numerous modifications within the scope of the appended claims.

What is claimed is:

1. A key ring assembly containing a laser indicator and various cutters, comprising a body, an upper cover, a laser generator, a metal plate, and a base, wherein said body is provided with a recess for receiving said laser generator and a battery chamber for receiving a battery unit; said upper cover having a front end provided with a cavity and a through hole, said cavity being adapted for receiving a replaceable lens frame, said lens frame being provided with plastic lenses containing geometric shapes or patterns or signs or words or characters so that laser beams of different shapes can be emitted; said upper cover being disposed on an upper side of said body, said metal plate being disposed below said body and having two spaced-apart positioning posts arranged at both front and rear ends of both top and bottom sides thereof for pivotal connection with four elastic curved arms, a file, a pen blade, and scissors, each of said file, said pen blade, said scissors having a retaining slot at a rear end thereof, and a finger dent on one side whereby the user can turn said file, said pen blade or said scissors outwardly with respect to said metal plate; said file, said pen blade, and said scissors being retained and positioned on said elastic curved arms by means of said retaining slots; said base being provided with a plurality of insert grooves adapted for receiving a plurality of said replaceable lens frames.

* * * * *